US006148934A

United States Patent [19]

Borg

[11] Patent Number: 6,148,934

[45] Date of Patent: Nov. 21, 2000

[54] COUPLING PIECE FOR USE AT SIMULTANEOUS EARTH AND/OR ROCK DRILLING WITH AN UPPER ROTARY PERCUSSION DEVICE AND A LOWER PERCUSSION DEVICE

[75] Inventor: Tomas Borg, Stocksund, Sweden

[73] Assignee: Atlas Copco Craelius AB, Marsta, Sweden

[21] Appl. No.: 09/254,810

[22] PCT Filed: Aug. 25, 1997

[86] PCT No.: PCT/SE97/01398

§ 371 Date: Mar. 15, 1999

§ 102(e) Date: Mar. 15, 1999

[87] PCT Pub. No.: WO98/12410

PCT Pub. Date: Mar. 26, 1998

[30] Foreign Application Priority Data

Sep. 19, 1996 [SE] Sweden ..... 960341

[51] Int. Cl.[7] ..... E21B 6/00

[52] U.S. Cl. ..... 175/296; 175/293

[58] Field of Search ..... 175/57, 92, 103, 175/135, 162, 171, 173, 293, 296

[56] References Cited

U.S. PATENT DOCUMENTS 5,355,966 10/1994 Mathis .

FOREIGN PATENT DOCUMENTS 9500766 1/1995 WIPO .

*Primary Examiner*—Robert E. Pezzuto
*Attorney, Agent, or Firm*—Mark P. Stone

[57] ABSTRACT

A coupling piece for use in drilling has a first connection (2) for connecting to an upper rotary percussion device (3), and a second connection (4) for connecting to a drill tube string (5) provided with an annular drill bit (23). The coupling piece has a first chamber (11) and a second chamber (12) separated by a piston. The pressure in the first chamber (11) is used to supply a lower percussion device (8) connected to a third connection (6) associated with the coupling piece with driving medium and for displacing the lower percussion device (8) towards the ground (15). The pressure in the second chamber (12) is used to decrease the force between the lower percussion device (8) and the ground (15) when further drill string elements are added to a drill string (7) of which the lower percussion device (8) forms a part.

1 Claim, 2 Drawing Sheets

COUPLING PIECE FOR USE AT SIMULTANEOUS EARTH AND/OR ROCK DRILLING WITH AN UPPER ROTARY PERCUSSION DEVICE AND A LOWER PERCUSSION DEVICE

BACKGROUND OF THE INVENTION

The present invention relates to a coupling piece with damping function for simultaneous earth and/or rock drilling with an upper rotary percussion device and a lower percussion device.

In a previously known drilling device, see U.S. Pat. No. 5,355,966, for simultaneous drilling with an upper rotary percussion device and a lower percussion device the feed force on the drill tube string and on the lower percussion device is achieved through displacement of the upper rotary percussion device towards the ground. A drawback with this solution is that drilling cannot occur optimally since one cannot control the feed force on the upper rotary percussion device and on the lower percussion device independent of each other for adaption of the drilling to local variations in the ground conditions.

SUMMARY OF THE INVENTION

The present invention, which is defined in the appended claim, aims at making it possible to drill simultaneously with an upper rotary percussion device and a lower percussion device with optimal use of feed force and impact energy at the same time as the lower percussion device is not affected by the shock waves of the uppeer rotary percussion device.

BRIEF DESCRIPTION OF THE DRAWINGS

An embodiment of the invention is described below with reference to the accompanying drawings in which.

DESCRIPTION OF THE BEST MODE FOR CARRYING OUT THE INVENTION

Figure 1:
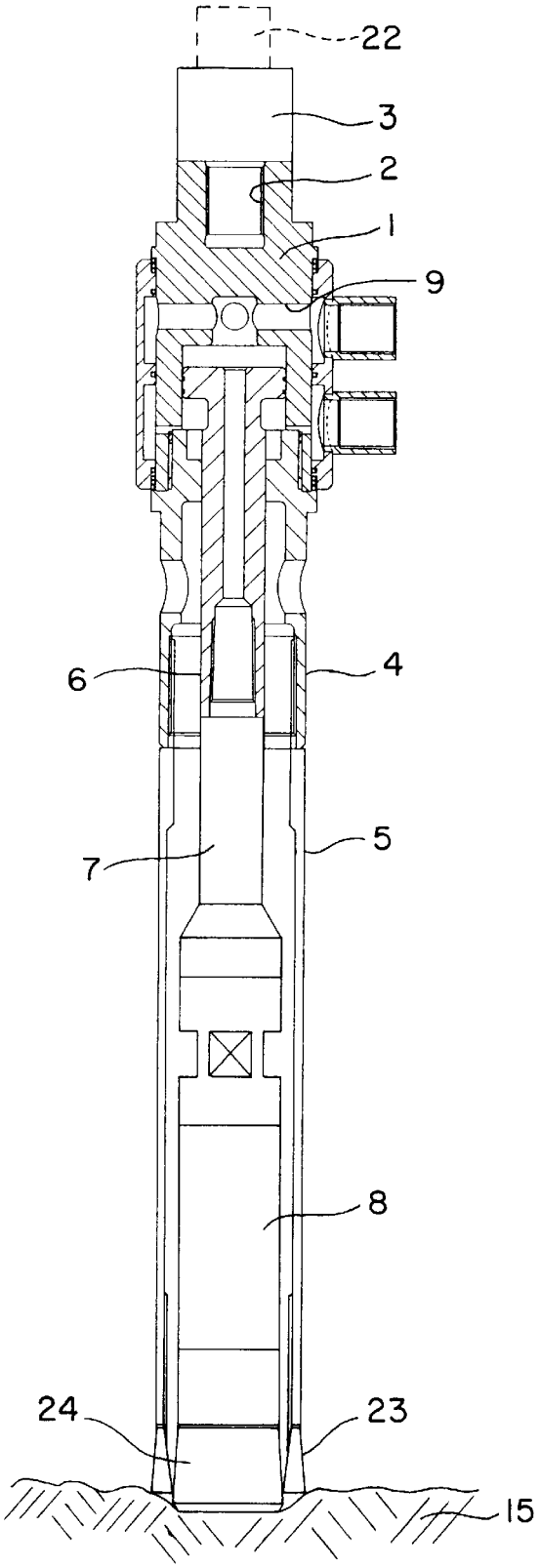
FIG. 1 shows a drilling device in which the invention is a part.
Figure 2:
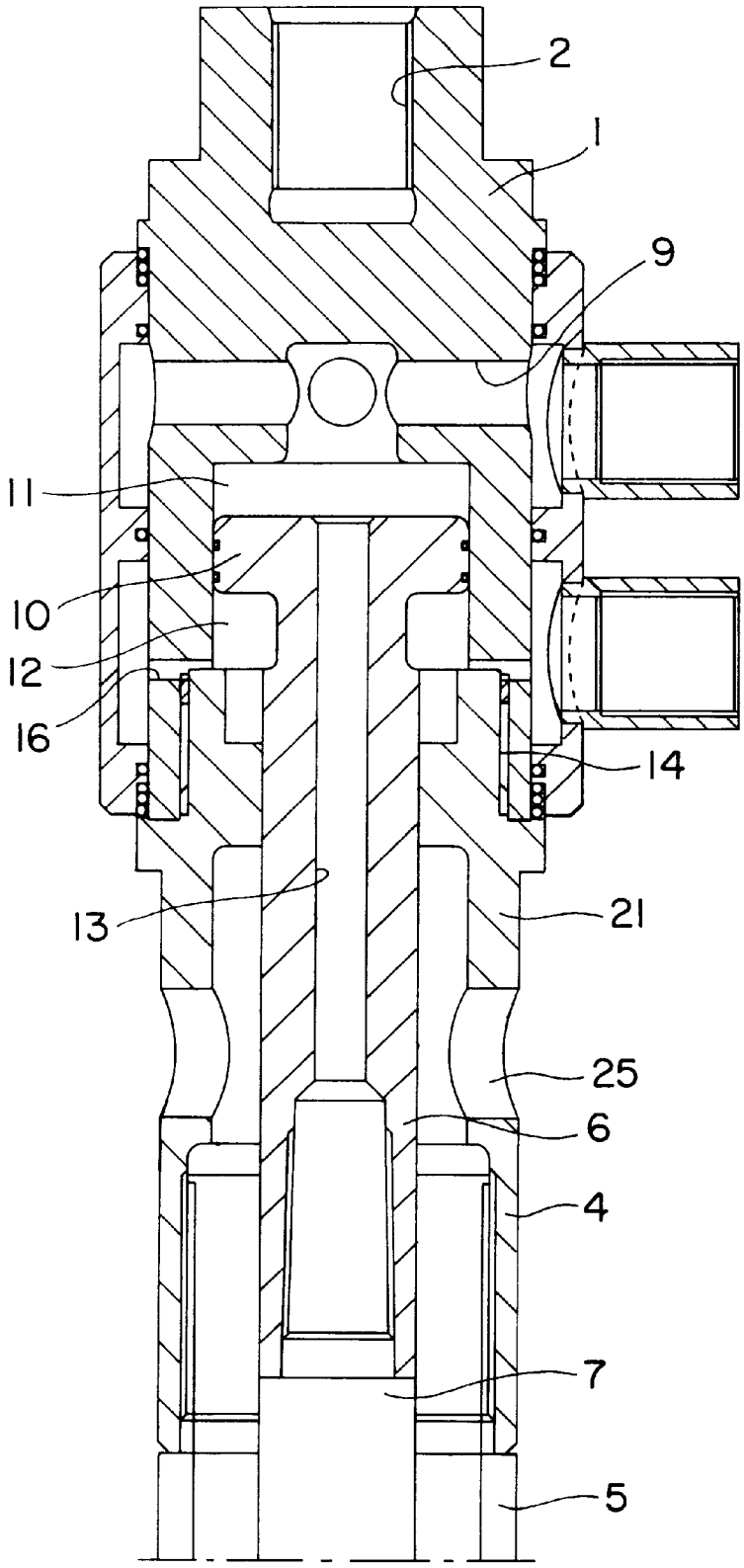
FIG. 2 shows a section through a coupling piece according to the invention.

The drilling device shown on the drawings comprises a coupling piece with a housing 1, 21. The housing comprises two housing parts 1 and 21 which are connected with each other by means of a screw joint 14. The housing part 1 is provided with a first connection 2 for connection of an upper rotary percussion device 3, in the shown example a top hammer drilling machine. The top hammer drilling machine is displaceable towards or from a ground 15, which can be an earth and/or rock formation, by means of a feed device 22. The housing part 21 is provided with a second connection 4 for connection of a drill tube string 5. The drill tube string 5 comprises one or more drill tubes and at the front end an annular drill bit 23. The annular drill bit 23 is fed towards the ground 15 by the feed device 22 and is exerted to impacts by the top hammer drilling machine 3. In the housing 1, 21 a piston 10 is movably arranged between a first chamber 11 and a second chamber 12. A third connection 6 is arranged on the piston 10 for connection of a drill string 7 comprising a lower percussion device 8, in the shown example a down-the-hole drilling machine. The drill string 7 can in addition to the down-the-hole drilling machine 8 comprise one or more drill string elements. At the front end of the down-the-hole drilling machine a drill bit 24 is arranged. The down-the-hole drilling machine 8 is supplied with driving medium, gas or liquid, via a first channel 9 in the housing part 1 and a second channel 13 in the piston 10. The pressure in the first chamber 11 displaces the down-the-hole drilling machine 8 and thus its drill bit 24 toward the ground 15. The drill bit 24 is exerted to impacts by the down-the-hole drilling machine 8. The first chamber 11 functions also as a shock absorber between the upper rotary percussion device 3 and the drill string 7, through which the down-the-hole drilling machine 8 is protected from harmful influence from the shock waves from the upper rotary percussion device. The housing part 1 is provided with a third channel 16 for supply of pressure fluid, gas or liquid, to the second chamber 12. Pressurization of the second chamber 12 is used to decrease the force between the down-the-hole drilling machine 8, and thus its drill bit 24, and the ground 15. This makes it possible to achieve the desired feed force on the drill bit 24 of the down-the-hole drilling machine when further drill string elements are added to the drill string 7, without waiving the driving medium pressure to the down-the-hole drilling machine. The driving medium to the down-the-hole drillng machine 8 is used for flushing the drill hole. The cuttings are therethrough transported uppwards in the space between the drill tube string 5 and the drill string 7 and leave the drilling device through holes 25 in the housing part 21.

What is claimed is:

1. Coupling earth or rock drilling simultaneously with an upper rotary percussion device and a lower percussion device, said coupling piece comprising a housing (1,21), a first connection (2) on said housing (1,21) for connection of an upper rotary percussion device (3), a second connection (4) on said housing (1,21) for connection of a drill tube string (5), a third connection (6) associated with said housing(1,21) for connection of a drill string (7) comprising a lower percussion device (8), and a first channel (9) arranged in said housing (1,21) for supply of driving medium to said lower percussion device (8), characterized in that said third connection (6) is connected with a piston (10) movable in said housing (1,21), that said piston is arranged between a first chamber (11) and a second chamber (12), that said first channel (9) is connected with said first chamber (11), that said piston (10) comprises a second channel (13) for transport of driving medium from said first chamber (11) to said lower percussion device (8), that pressurization of said first chamber (11) causes displacement of said lower percussion device (8) toward a ground (15) for drilling, and that said housing (1,21) comprises a third channel (16) for supply of pressure flluid to said second chamber (12), and that pressurization of said second chamber (12) causes a decrease of the force between said lower percussion device (8) and said ground (15).

* * * * *

UNITED STATES PATENT AND TRADEMARK OFFICE

CERTIFICATE OF CORRECTION

PATENT NO. : 6,148,934

DATED : November 21, 2000

INVENTOR(S) : Tomas Borg

It is certified that error appears in the above-identified patent and that said Letters Patent is hereby corrected as shown below:

Claim 1, Line 1 (Col. 2, Line 35):

After "Coupling", add: - -piece for use at- -

Signed and Sealed this

Eighth Day of May, 2001

*Attest:*

Nicholas P. Godici

NICHOLAS P. GODICI

*Attesting Officer*

*Acting Director of the United States Patent and Trademark Office*